US010818128B2

(12) United States Patent
Hawkins et al.

(10) Patent No.: US 10,818,128 B2
(45) Date of Patent: Oct. 27, 2020

(54) BONUS WHEEL WITH TOP-LEVEL PROGRESSIVE AWARD

(71) Applicant: Aristocrat Technologies Australia Pty Limited, North Ryde, NSW (AU)

(72) Inventors: Ryan Hawkins, Henderson, NV (US); Stephanie Johns, Las Vegas, NV (US); Yanis Tsombanidis, Las Vegas, NV (US); Robert Honeycutt, Henderson, NV (US)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 0 days.

(21) Appl. No.: 16/013,819

(22) Filed: Jun. 20, 2018

(65) Prior Publication Data

US 2019/0392674 A1 Dec. 26, 2019

(51) Int. Cl.
*G07F 17/32* (2006.01)
*G07F 17/34* (2006.01)

(52) U.S. Cl.
CPC ..... *G07F 17/3213* (2013.01); *G07F 17/3258* (2013.01); *G07F 17/3267* (2013.01); *G07F 17/34* (2013.01)

(58) Field of Classification Search
None
See application file for complete search history.

(56) References Cited

U.S. PATENT DOCUMENTS

| | | | | |
|---|---|---|---|---|
| 5,788,573 | A * | 8/1998 | Baerlocher | G07F 17/32 273/138.2 |
| 2007/0218982 | A1 | 9/2007 | Baerlocher | |
| 2009/0239635 | A1* | 9/2009 | Graham | 463/20 |
| 2014/0018164 | A1 | 1/2014 | Vallejo et al. | |
| 2015/0080087 | A1 | 3/2015 | Nicely et al. | |
| 2019/0043314 | A1* | 2/2019 | Abrahamson | G07F 17/3267 |

OTHER PUBLICATIONS

"Celestial Sun Riches Slot * Great Win in Bonus Free Games—SunFlower Slots", YouTube video, (Apr. 24, 2018), https://www.youtube.com/watch?v=BtwVuc46p8M (or https://www.bing.com/videos/search?q=Celestial+Moon+Riches+slot+game&&view=detail&mid=F444E83A609B4438E917F444E83A609B4438E917&&Form=VDRVRV) (Year: 2018).*

* cited by examiner

*Primary Examiner* — Damon J Pierce
(74) *Attorney, Agent, or Firm* — Weaver Austin Villeneuve & Sampson LLP

(57) ABSTRACT

After determining that a player has won a base game, an electronic gaming machine may award one or more free instances of a game as a bonus game or a round of bonus games. If the EGM determines that a player has won a bonus game, the EGM may present a bonus wheel. The bonus wheel may be partitioned into segments, one of which corresponds to a top-level progressive award. Other segments may correspond to multipliers of an amount won in the bonus game. A player may have a chance to win the top-level progressive award during each spin of the bonus wheel, even if the player has already won the top-level progressive award during a prior spin of the bonus wheel during the same round of bonus games. The bonus wheel may be a "weighted" wheel.

14 Claims, 8 Drawing Sheets

600

600

BONUS WHEEL WITH TOP-LEVEL PROGRESSIVE AWARD

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

After determining that a player has won a base game, an electronic gaming machine (EGM) may award one or more free instances of a game, which may be referred to herein as a bonus game. In some examples, a bonus game may be an instance of the base game, but in alternative implementations the bonus game may be another type of game. If the EGM determines that a player has won a bonus game, the EGM may present a bonus wheel. The bonus wheel may be partitioned into segments, one of which corresponds to a top-level progressive award. Other segments may correspond to multipliers of an amount won in the bonus game. A player may have a chance to win the top-level progressive award during each spin of the bonus wheel, even if the player has already won the top-level progressive award during a prior spin of the bonus wheel during the same round of bonus games. The bonus wheel may be a "weighted" wheel, in which size of a bonus wheel segment does not necessarily correspond with the probability of the outcome indicated on the bonus wheel segment.

DETAILED DESCRIPTION

Figure 1:
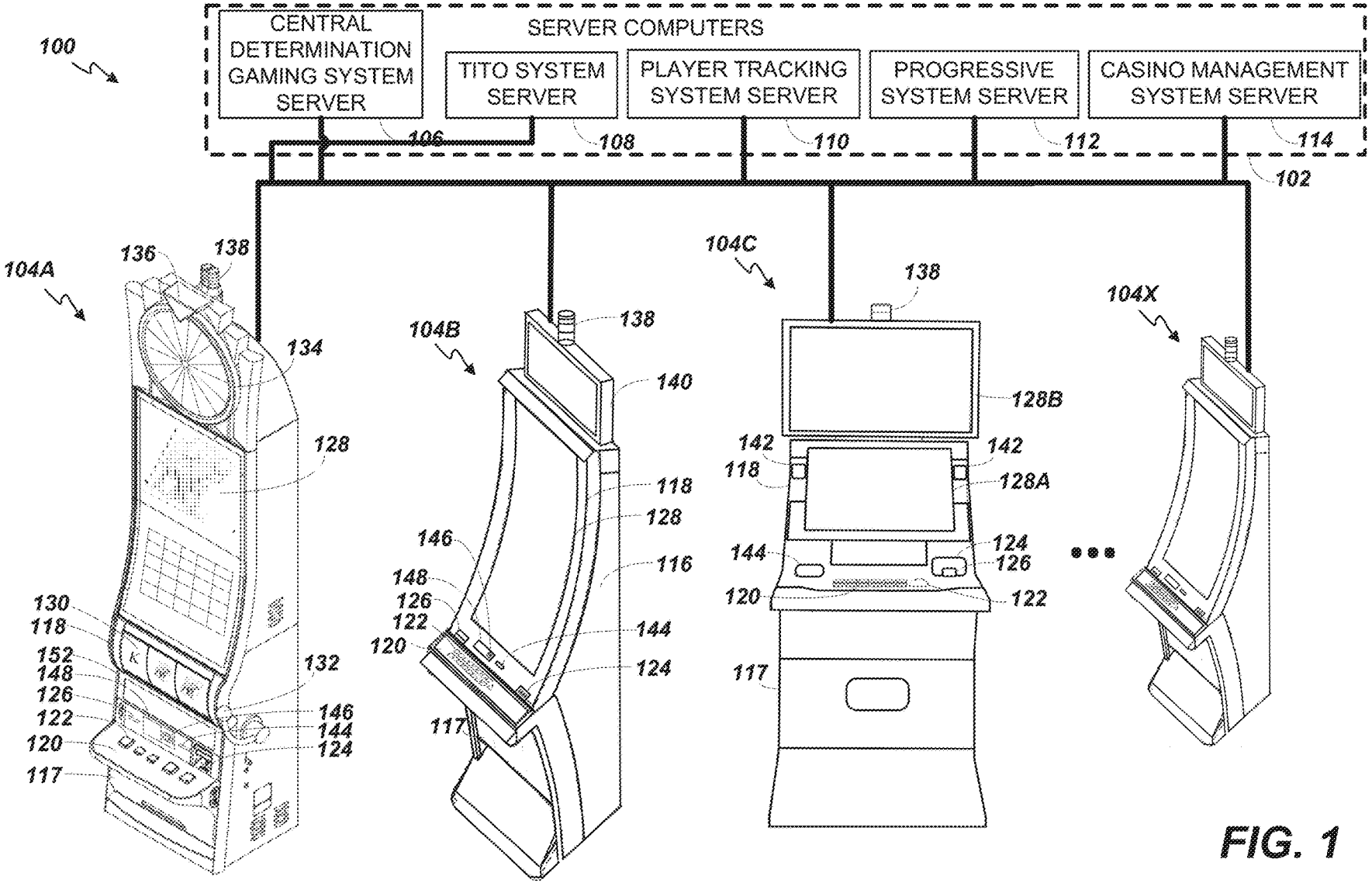
FIG. 1 is a diagram showing examples of several EGMs networked with various gaming related servers.

FIG. 1 illustrates several different models of EGMs which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 1046 or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 117 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
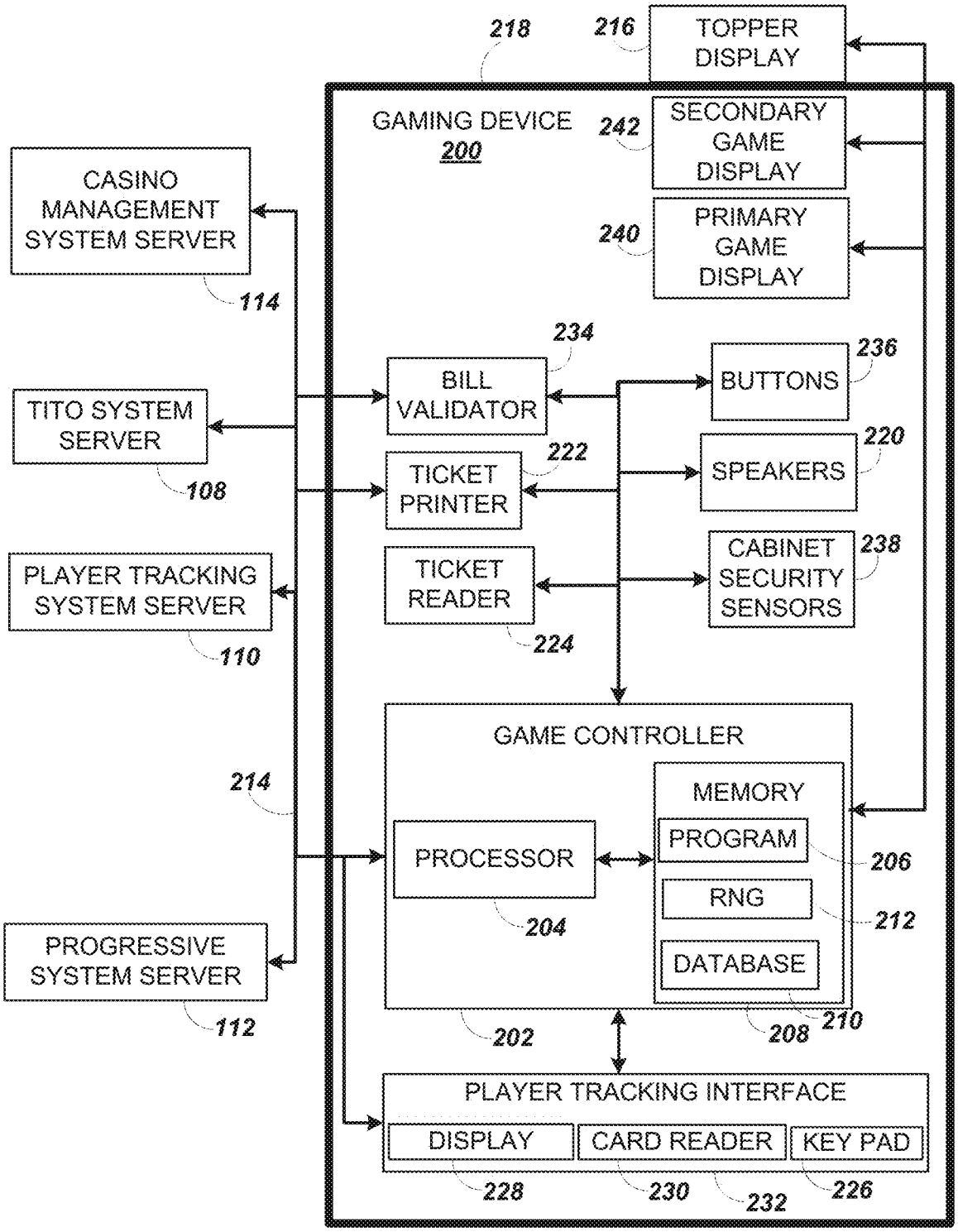
FIG. 2 is a block diagram showing examples of various functional elements of an EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 117 which opens to provide access to the interior of the gaming device 104B. The main or service door 117 is typically used by service personnel to refill the ticket-out printer 126 and collect bills and tickets inserted into the bill validator 124. The door 117 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 1286 is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting examples of internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (i.e. a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Figure 3:
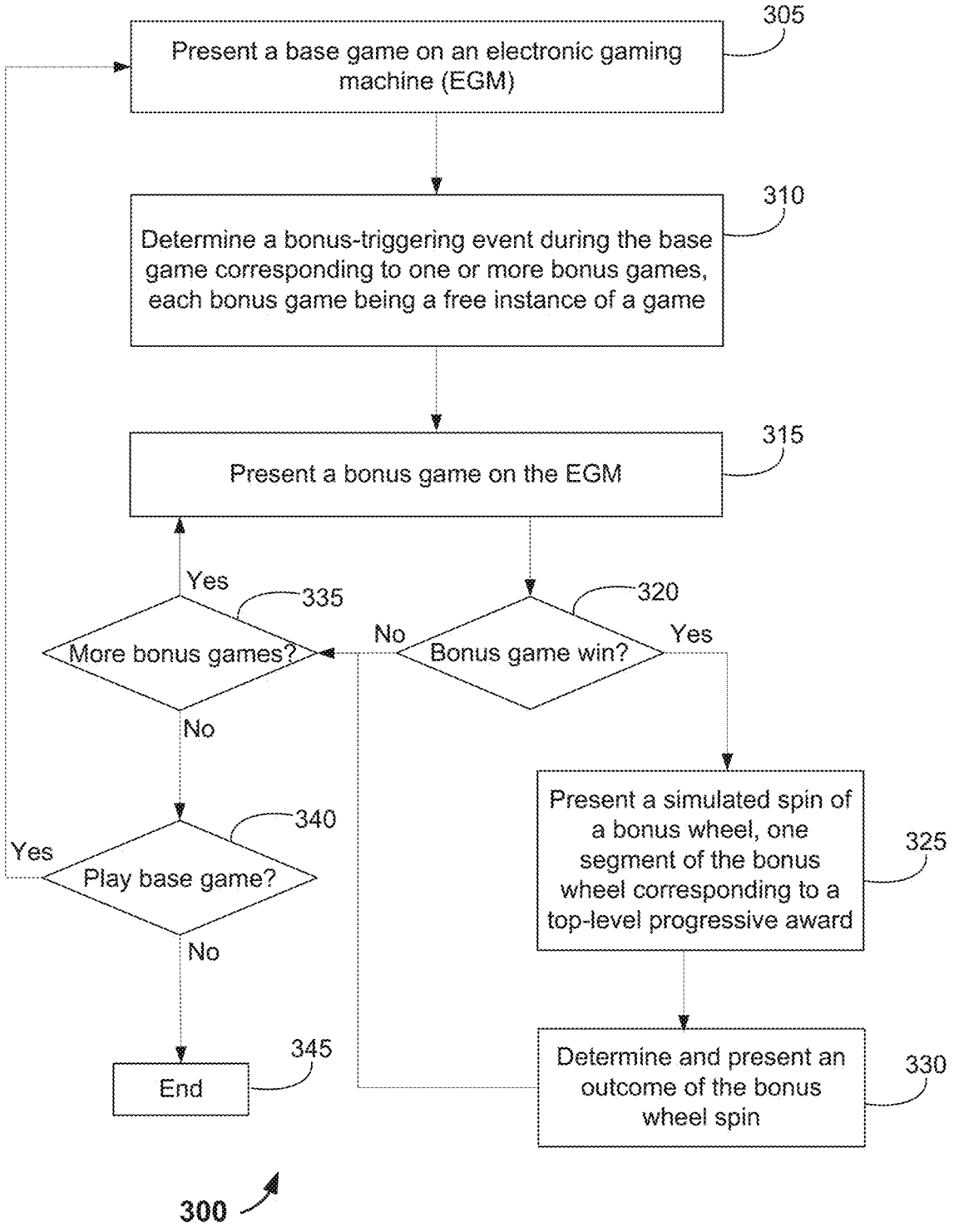
FIG. 3 is a flow diagram that shows blocks of a method according to one example.

FIG. 3 is a flow diagram that shows blocks of a method according to one example. Method 300 may be performed, at least in part, by a control system of an EGM. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components. Accordingly, the control system may include one or more processors and may be, or may include, an instance of the game controller 202 described above with reference to FIG. 2. In some implementations the control system may include one or more non-transitory storage media operatively coupled to the one or more processors. In some examples, the method 300 may be performed by an EGM according to software stored upon one or more non-transitory storage media.

According to this example, block 305 involves presenting a base game on an EGM. In some implementations, block 305 involves presenting a mechanical slot game or a video slot game on an EGM. However, in other implementations block 305 may involve presenting another type of game on an EGM, such as a video poker game, a video black jack game, a video pachinko game, a keno game, a bingo game, etc. Accordingly, block 305 may involve controlling a display system of the EGM to present first visual effects corresponding to a base game. The display system may include one or more displays.

Figure 4A:
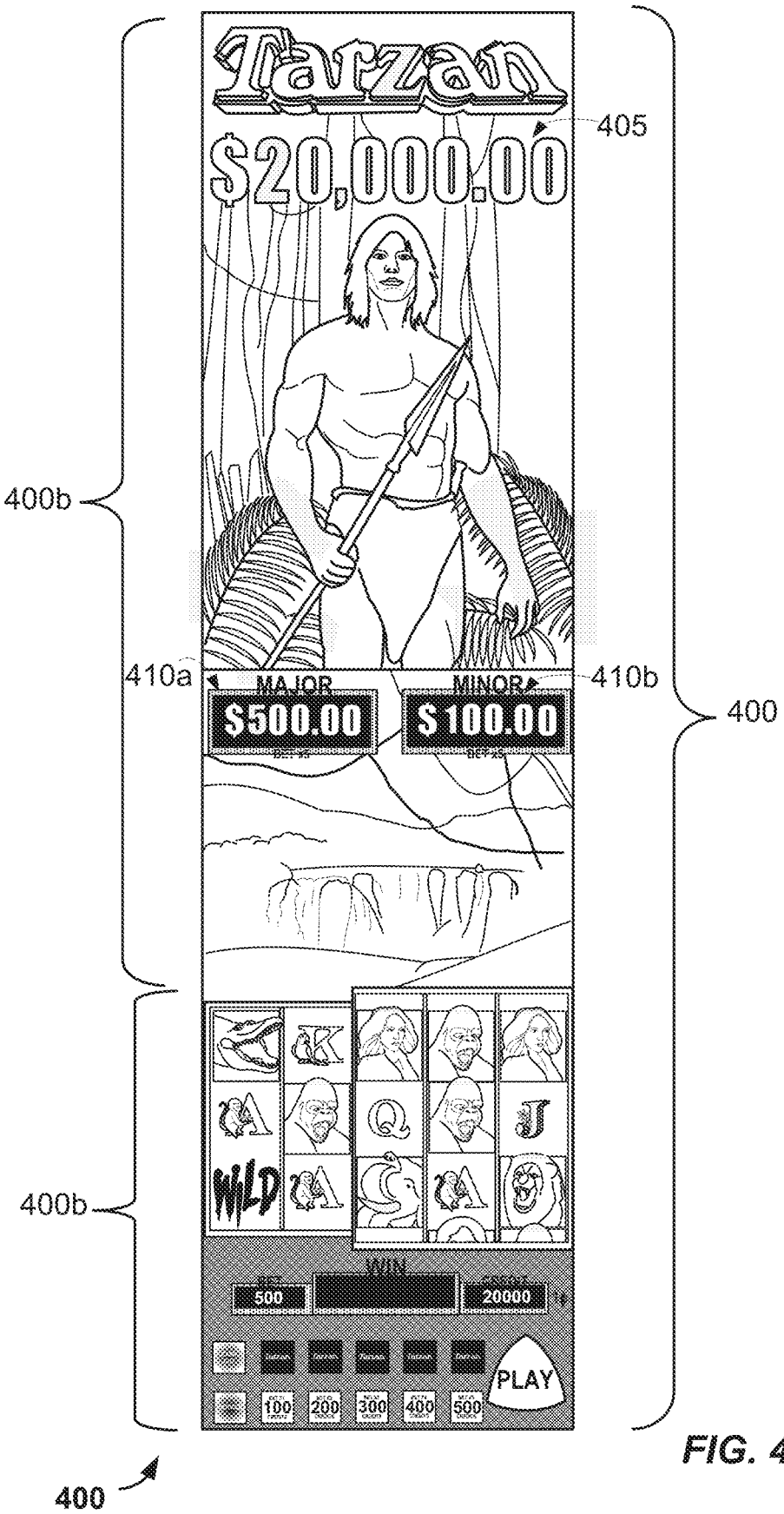
FIG. 4A shows an example of a base game being presented on an EGM.

FIG. 4A shows an example of a base game being presented on an EGM. The numbers and types of elements shown on FIG. 4A are merely examples. This example is based on a "screen shot" of an image 400 that is presented during the presentation of Aristocrat's Tarzan™ base game. (Intellectual property rights for Tarzan (both trademarks and copyrights) are owned by Edgar Rice Burroughs, Inc., and are being used by permission.) In some implementations, a control system of an EGM may cause a display system to present the entire image 400 on a single display, such as the main display 128 that is described above with reference to FIG. 1. In some implementations, the display system may include more than one display. According to some such implementations, the control system may control the display system present a portion of the image 400 on one display and the remainder of the image 400 in one or more other displays. For example, the control system may control the display system present the image portion 400*a* on a primary game display and to present the image portion 400*b* on a secondary game display.

In addition to images that correspond with the Tarzan™ theme, the image portion 400*b* includes information about three progressive jackpots that a player could potentially win. Area 405 indicates the current value of a top-level or "grand" progressive award. Windows 410*a* and 410*b* indicate the current values of a "major" progressive award and a "minor" progressive award, respectively. The major and minor progressive awards are both less than the top-level progressive award. Windows 410*a* and 410*b* also indicate that a player needs to bet X5, which corresponds to 500 credits in this example, in order to qualify for winning the major progressive award or the minor progressive award.

Figure 4B:
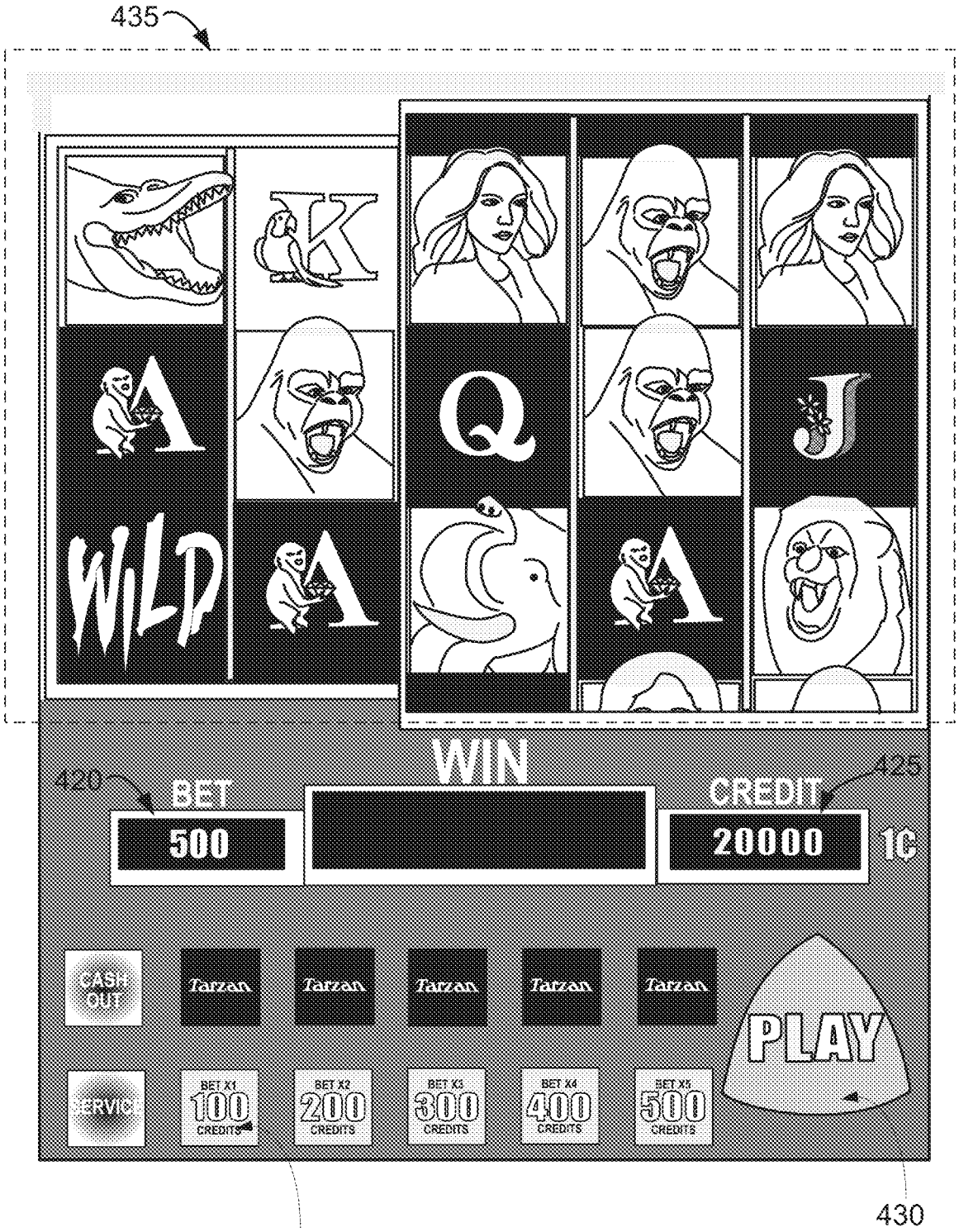
FIG. 4B shows an enlarged view of the image portion 400*b* that is shown in FIG. 4A.

FIG. 4B shows an enlarged view of the image portion 400*b* that is shown in FIG. 4A. According to this example, wagering buttons 415 allow a player to select a desired wager amount. Here, a player may select between wagers of 100, 200, 300, 400 or 500 credits. Other implementations may allow different levels of wagering, which may be implemented via more or fewer wagering buttons 415. In this example, the wagering buttons 415 and other buttons depicted in FIG. 4B are implemented via a touch screen associated with a display of the EGM. In other implementations, the buttons may be physical buttons.

In this implementation, the window 420 indicates the amount of a current wager. Here, window 425 shows the amount of a player's remaining credit. In this example, a player may touch the play button 430 to initiate another instance of a game.

According to this example, the EGM's control system controls a display system to simulate reels of a slot game in area 435. Upon initiation of play, the control system may be configured to randomly determine a game outcome and to control the display system to display symbols that correspond to the game outcome. If the control system determines that a game outcome is a winning outcome, the control system may be configured not only to control the display system to display a winning combination of symbols (e.g., instances of the same symbol across a pay line), but also to control the EGM to provide other visual and auditory effects that correspond to the winning game outcome, including but not limited to an indication of the amount of an award of the base game.

Returning to FIG. 3, in this example block 310 involves determining a bonus-triggering event during the base game. In this example, the bonus-triggering event corresponds to an award of a bonus round that includes one or more free instances of a game, which may be referred to herein as a bonus game. According to some examples, the bonus round may involve presenting one or more free instances of the base game. For example, if the base game is a slot game, block 310 may involve awarding one or more spins of the slot game without requiring payment for these spins of the slot game. However, in alternative implementations the bonus round may involve presenting one or more free instances of a game that is different from the base game. For example, if the base game is a slot game, block 310 may involve awarding one or more free instances of a video poker game. In some implementations, the bonus-triggering event corresponds to a particular combination of symbols. According to some such implementations, block 310 may involve determining that a player has won the base game. Block 310 may, for example, involve determining that a player has won the base game that is depicted in FIG. 4A. However, the combination of symbols may or may not correspond to a win of the base game, depending on the particular implementation. For example, in some implementations of Aristocrat's Tarzan™ game, the bonus-triggering event corresponds to a display of at least three "scatter" symbols on the simulated reels of the base game display. Accordingly, block 310 may correspond with a determination regarding the base game that is made by a control system of an EGM.

However, in alternative implementations block 310 may involve determining a bonus-triggering event that does not correspond with a "win" of the base game. According to some such implementations, the bonus-triggering event may not correspond to a winning combination of symbols, cards, etc., that are presented during the base game. According to such implementations, a player may not be able to determine, based on visual effects corresponding to a base game, what the bonus-triggering event was.

In some examples, block 310 may involve a determination made by a device other than the EGM that is presenting the base game. In some implementations determining a bonus-triggering event may involve receiving, via a network interface system of an EGM, data corresponding to the bonus-triggering event. Such data may, for example, be received from a game server or a progressive system server.

According to this implementation, block 315 involves presenting a bonus game on the EGM. In this example, block 320 involves determining (e.g., by a control system of the EGM) whether a player has won the bonus game. If it is determined in block 320 that the player has not won the bonus game, in this example method 300 proceeds to block 335.

However, if it is determined in block 320 that the player has won the bonus game, block 320 may involve determining an award corresponding to the win. Moreover, if it is determined in block 320 that the player has won the bonus game, in this implementation a simulated spin of a bonus wheel is presented on the EGM in block 325. In alternative implementations, the bonus wheel may be stationary while a simulated rotation of a pointer around the bonus wheel is presented on the EGM in block 325.

According to this example, the bonus wheel is partitioned into segments. In this example, one segment of the bonus wheel corresponds to a top-level progressive award. Other bonus wheel segments may, for example, correspond to multipliers of an amount won in the bonus game.

Figure 5A:
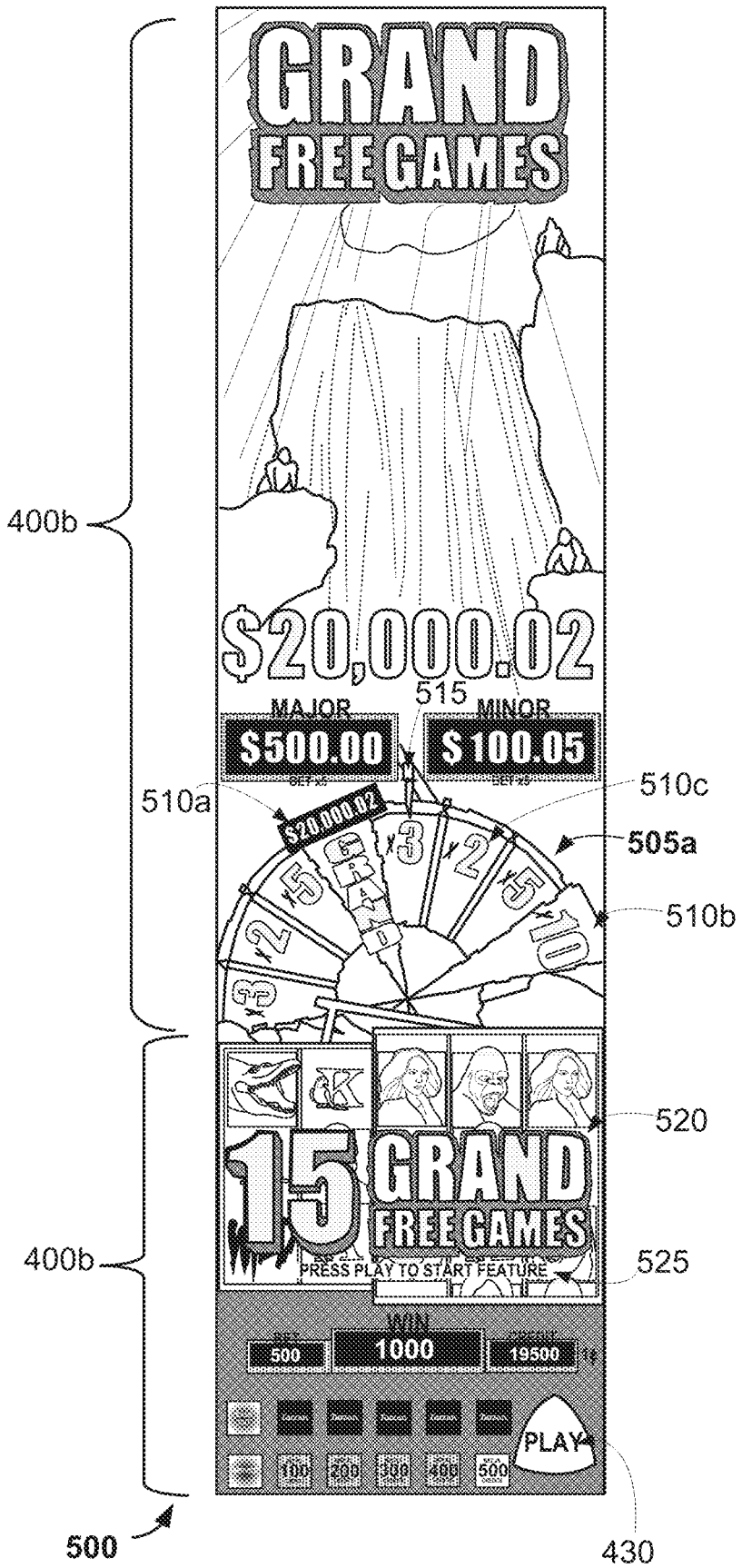
FIG. 5A shows an example of a bonus wheel being displayed on an EGM.

FIG. 5A shows an example of a bonus wheel being displayed on an EGM. In this example, the bonus wheel 505*a* is partitioned into bonus wheel segments 510. Here, the bonus wheel segment 510*a* corresponds to a top-level progressive award. In this implementation, the bonus wheel segment 510*a* indicates the current value of the top-level progressive award, in order to further enhance the player's excitement. Here, other bonus wheel segments 510 correspond to multipliers of an amount won in the bonus game. For example, the bonus wheel segment 510*b* corresponds to a 10× multiplier of the amount won in the bonus game.

According to this example, the bonus wheel 505*a* is a "weighted" wheel, in which size of a bonus wheel segment 510 does not necessarily correspond with the probability of the outcome indicated on the bonus wheel segment. For example, the size of the bonus wheel segment 510*c*, which corresponds to a 2× multiplier, is approximately the same size as the bonus wheel segment 510*a*. However, in this example the probability of the 2× multiplier outcome is not the same as that of winning the top-level progressive award.

In this example, block 330 involves determining and presenting an outcome of the bonus wheel spin. One example of presenting an outcome of the bonus wheel spin is described below with reference to FIG. 6. Depending on the particular implementation, block 325 may involve a determination by a control system of the EGM or a determination by another device, such as a progressive system server. For example, block 325 may involve receiving, via a network interface system of an EGM, data corresponding to an outcome for a spin of the bonus wheel. In the example shown in FIG. 5A, outcomes are indicated after each simulated spin of the bonus wheel by the particular bonus wheel segment 510 that is displayed adjacent to the pointer 315. Block 325 may involve presenting on a display an amount awarded as a result of the bonus wheel spin and may involve presenting a visual and/or audio celebration of the award.

In this example, method 300 then proceeds to block 335, which involves determining whether the player is entitled to any additional bonus games. In the example shown in FIG. 5A, area 520 indicates the number of bonus games corresponding to the bonus-triggering event. Here, area 520 indicates that a player has been awarded 15 free instances of the base game, which corresponds to 15 free simulated spins of the video slot reels. Area 525 of the display shown in FIG. 5A includes a message encouraging the player to press the play button 430 in order to start the bonus round. After an initial bonus game the player would still have 14 additional free spins remaining. Therefore, block 335 would involve determining that the player has additional bonus games to play and method 300 would revert to block 315.

In the example shown in FIG. 3, blocks 315, 320 and 335 would be repeated until it is determined in block 335 that the player is not entitled to any additional bonus game. Blocks 325 and 330 would also be performed in the event of any bonus game wins. After it is determined in block 335 that the player is not entitled to any additional bonus game, in this example it is determined in block 340 whether the player wishes to play an additional instance of the base game. For example, the EGM may provide visual and/or audio prompts to play the base game in block 340 and the EGM may determine whether the player authorizes payment for further instances of the base game. If it is determined in block 340 that the player wishes to play an additional instance of the base game, the process reverts to block 305 in this example. If not, the process ends in this example. According to some examples, the EGM may provide the player's credit balance in block 345, e.g., in response to detecting input from the player's interaction with a "cash out" button in block 340. In block 345, the EGM may provide a cash out ticket from a ticket printer, such as the ticket printer 222 shown in FIG. 2.

Figure 5B:
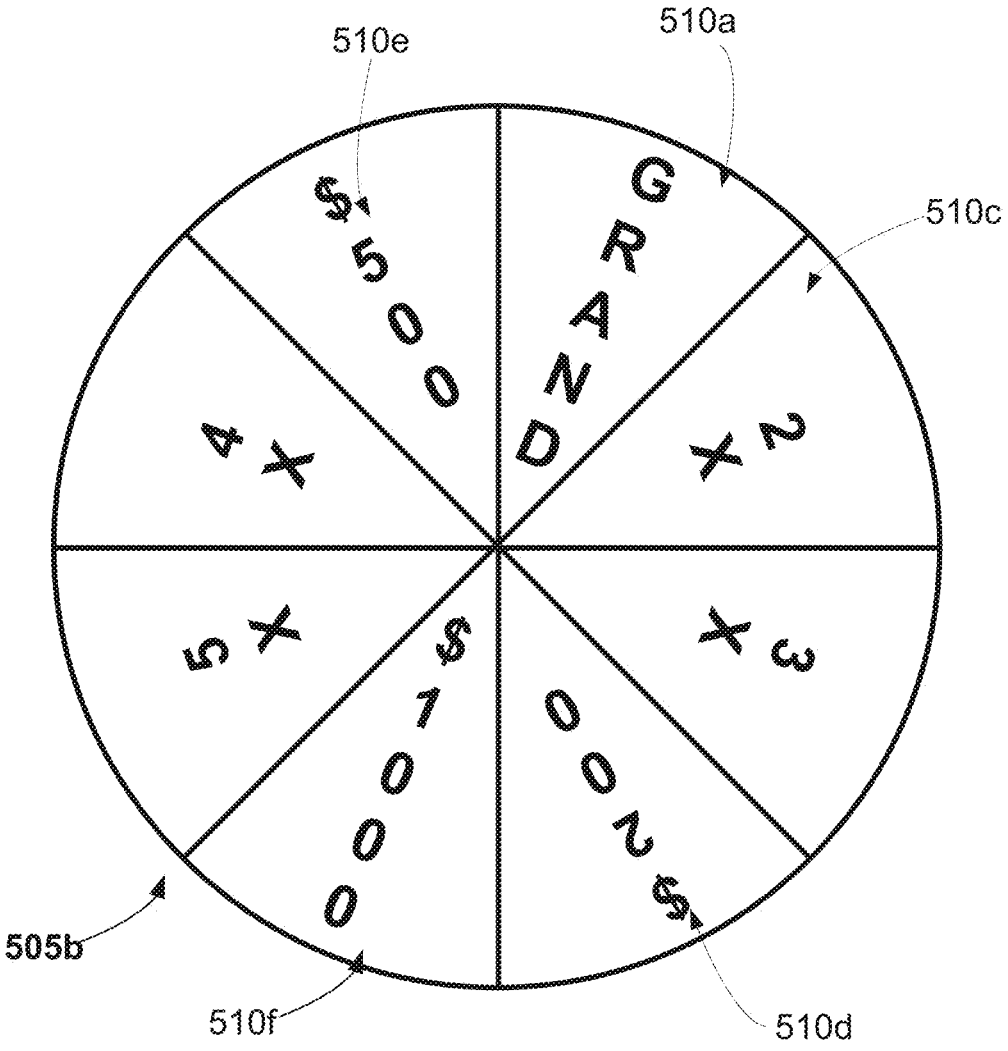
FIG. 5B shows an alternative example of a bonus wheel.

FIG. 5B shows an alternative example of a bonus wheel. In this example, the bonus wheel 505*b* includes the bonus wheel segment 510*c*, which corresponds to a 2× multiplier, as well as the bonus wheel segment 510*a*, which corresponds to a top-level progressive award. However, in this implementation the bonus wheel 505*b* also include bonus wheel segments that correspond to awards of specific dollar amounts: here, the bonus wheel segments 510*d*, 510*e* and 510*f* correspond to awards of $200, $500 and $1000, respectively.

According to this example, the bonus wheel 505*b* is a weighted wheel, in which size of a bonus wheel segment 510 does not necessarily correspond with the probability of the outcome indicated on the bonus wheel segment. For example, the size of the bonus wheel segment 510*d*, which corresponds to a $200 cash award, is approximately the same size as the bonus wheel segment 510*f*, which corresponds to a $1000 cash award. However, in this example the probability of the $200 cash award outcome is not the same as that of winning the $1000 cash award.

Figure 6:
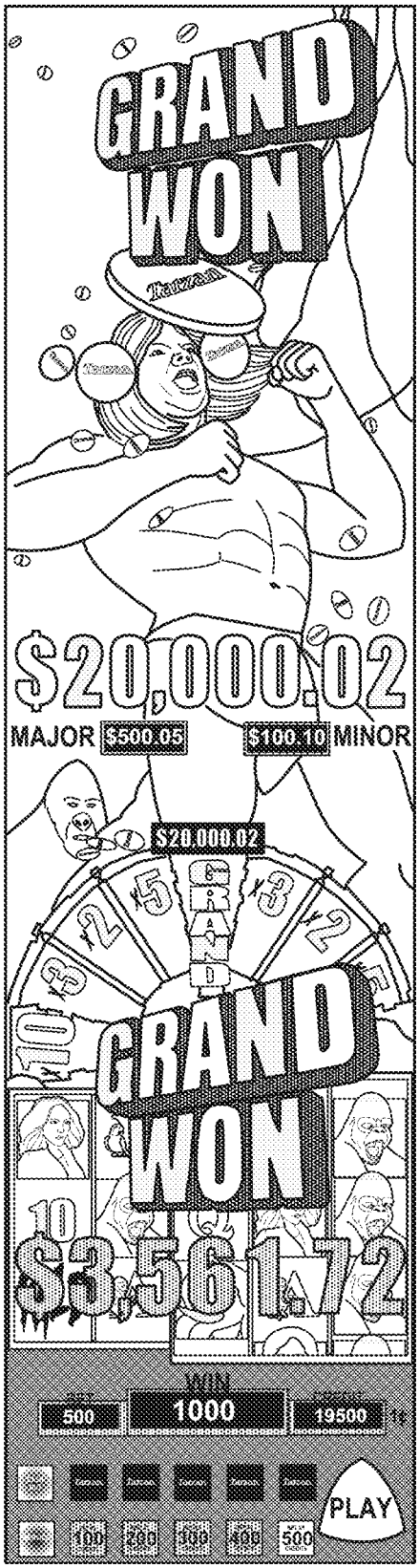
FIG. 6 shows an example of a display presented on an EGM that corresponds with winning a top-level progressive award.

FIG. 6 shows an example of a display presented on an EGM that corresponds with winning a top-level progressive award. The display depicted in FIG. 6 may, for example, be presented in block 330 of FIG. 3. In this example, the image 600 depicts a frame of a celebration video that is provided on the display system of an EGM upon determining a win of the top-level progressive award. Here, the image 600 indicates the top-level progressive award amount that the player has won. During this celebration video Tarzan beats his chest and gold coins fall from the sky. In some examples, celebration audio effects, which may include music and/or the well-known Tarzan yell, are provided via one or more speakers of the EGM.

According to some implementations, player may have a chance to win the top-level progressive award during each spin of the bonus wheel. For example, even if the player has already won the top-level progressive award during a prior spin of the bonus wheel during the same round of bonus games, the player may nonetheless have a chance to win the top-level progressive award during a subsequent spin of the bonus wheel.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. An electronic gaming machine, comprising:

a display system including one or more displays; and a control system including one or more processors, the control system being configured for:

controlling the display system to present first visual effects corresponding to a base game, the base game including a slot game;

determining a bonus-triggering event during the base game, the bonus-triggering event corresponding to an award of a bonus round comprising one or more free instances of a game;

controlling the display system to present second visual effects corresponding to the bonus round;

determining an award of a bonus game during the bonus round;

controlling the display system to present third visual effects corresponding to the award of the bonus game, the third visual effects including a bonus wheel having multiple bonus wheel segments, at least a first one of the bonus wheel segments corresponding to a top-level progressive award, all of the bonus wheel segments except the first one of the bonus wheel segments correspond to one of a plurality of multipliers for the award of the bonus game, and a size of a bonus wheel segment does not correspond with a probability of an outcome corresponding to the bonus wheel segment;

determining a first top-level progressive award that is an outcome of a first spin of the bonus wheel, the first top-level progressive award being a first awarding of a highest level progressive jackpot of a plurality of potentially available progressive jackpots;

controlling the display system to present fourth visual effects corresponding to a first top-level progressive award amount;

determining a second top-level progressive award that is an outcome of a second spin of the bonus wheel, the second top-level progressive award being another awarding of the highest level progressive jackpot of the plurality of potentially available progressive jackpots; and controlling the display system to present fifth visual effects corresponding to a second top-level progressive award amount.

2. The electronic gaming machine of claim 1, wherein the control system is further configured for:

determining an outcome of a first instance of presenting the bonus wheel; and controlling the display system to indicate a selected bonus wheel segment corresponding with the outcome of the first instance of presenting the bonus wheel.

3. The electronic gaming machine of claim 2, wherein controlling the display system to indicate the selected bonus wheel segment comprises controlling the display system to simulate a spin of the bonus wheel.

4. The electronic gaming machine of claim 1, further comprising a network interface system, wherein determining at least one of the bonus-triggering event or the award of the bonus game comprises receiving data via the network interface system.

5. The electronic gaming machine of claim 1, wherein the award of the bonus game corresponds to a combination of symbols presented on the display system during the bonus game.

6. The electronic gaming machine of claim 1, wherein the bonus round comprises one or more free instances of the base game.

7. A method of controlling an electronic gaming machine, the method comprising:

controlling, via a control system that includes one or more processors, a display system including one or more displays to present first visual effects corresponding to a base game, the base game including a slot game;

determining, by the control system, a bonus-triggering event during the base game, the bonus-triggering event corresponding to an award a bonus round comprising one or more free instances of a game;

controlling, by the control system, the display system to present second visual effects corresponding to the bonus round;

determining, by the control system, an award of a bonus game during the bonus round;

controlling, by the control system, the display system to present third visual effects corresponding to the award of the bonus game, the third visual effects including a bonus wheel having multiple bonus wheel segments, at least a first one of the bonus wheel segments corresponding to a top-level progressive award, all of the bonus wheel segments except the first one of the bonus wheel segments correspond to one of a plurality of multipliers for the award of the bonus game, and a size of a bonus wheel segment does not correspond with a probability of an outcome corresponding to the bonus wheel segment;

determining, by the control system, a first top-level progressive award that is an outcome of a first spin of the bonus wheel, the first top-level progressive award being a first awarding of a highest-level progressive jackpot of a plurality of potentially available progressive jackpots;

controlling, by the control system, the display system to present fourth visual effects corresponding to a first top-level progressive award amount;

determining, by the control system, a second top-level progressive award that is an outcome of a second spin of the bonus wheel, the second top-level progressive award being another awarding of the highest-level progressive jackpot of the plurality of potentially available progressive jackpots; and controlling, by the control system, the display system to present fifth visual effects corresponding to a second top-level progressive award amount.

8. The method of claim 7, wherein the award of the bonus game corresponds to a combination of symbols presented on the display system during the bonus game.

9. The method of claim 7, wherein the control system is further configured for:

determining an outcome of a first instance of presenting the bonus wheel; and controlling the display system to indicate a selected bonus wheel segment corresponding with the outcome of the first instance presenting of the bonus wheel.

10. The method of claim 9, wherein controlling the display system to indicate the selected bonus wheel segment comprises controlling the display system to simulate a spin of the bonus wheel.

11. The method of claim 7, wherein determining at least one of the bonus-triggering event or the award of the bonus game comprises receiving data via a network interface system corresponding to the bonus-triggering event.

12. The method of claim 7, wherein the bonus round comprises one or more free instances of the base game.

13. One or more non-transitory media having software stored thereon, the software including instructions for controlling one or more devices to perform a gaming method, the gaming method comprising:

controlling, via a control system that includes one or more processors, a display system including one or more displays to present first visual effects corresponding to a base game, the base game including a slot game;

determining, by the control system, a bonus-triggering event during the base game, the bonus-triggering event corresponding to an award a bonus round comprising one or more free instances of a game;

controlling, by the control system, the display system to present second visual effects corresponding to the bonus round;

determining, by the control system, an award of a bonus game during the bonus round;

controlling, by the control system, the display system to present third visual effects corresponding to the award of the bonus game, the third visual effects including a bonus wheel having multiple bonus wheel segments, at least a first one of the bonus wheel segments corresponding to a top-level progressive award, all of the bonus wheel segments except the first one of the bonus wheel segments correspond to one of a plurality of multipliers for the award of the bonus game, and a size of a bonus wheel segment does not correspond with a probability of an outcome corresponding to the bonus wheel segment;

determining, by the control system, a first top-level progressive award that is an outcome of a first spin of the bonus wheel, the first top-level progressive award being a first awarding of a highest-level progressive jackpot of a plurality of potentially available progressive jackpots;

controlling, by the control system, the display system to present fourth visual effects corresponding to a first top-level progressive award amount;

determining, by the control system, a second top-level progressive award that is an outcome of a second spin of the bonus wheel, the second top-level progressive award being another awarding of the highest-level progressive jackpot of the plurality of potentially available progressive jackpots; and controlling, by the control system, the display system to present fifth visual effects corresponding to a second top-level progressive award amount.

14. The one or more non-transitory media of claim 13, wherein the award of the bonus game corresponds to a combination of symbols presented on the display system during the bonus game.

* * * * *